US010753595B1

(12) United States Patent
Wan

(10) Patent No.: US 10,753,595 B1
(45) Date of Patent: Aug. 25, 2020

(54) HIGH PERFORMANCE WATERPROOF LED DECORATIVE LAMP WITH ENHANCED WATERPROOF STRUCTURE FOR PROLONGED LIFE

(71) Applicant: Dongguan Huadeng Lighting Co., Ltd, Guangdong (CN)

(72) Inventor: Huaping Wan, Guangdong (CN)

( * ) Notice: Subject to any disclaimer, the term of this patent is extended or adjusted under 35 U.S.C. 154(b) by 0 days.

(21) Appl. No.: 16/414,731

(22) Filed: May 16, 2019

(30) Foreign Application Priority Data

Apr. 18, 2019 (CN) ..... 2019 2 0531419 U

(51) Int. Cl.

| | |
|---|---|
| ***F21V 3/00*** | (2015.01) |
| ***F21V 31/00*** | (2006.01) |
| ***F21K 9/237*** | (2016.01) |
| ***F21V 19/00*** | (2006.01) |
| ***F21V 3/02*** | (2006.01) |

(52) U.S. Cl.
CPC ..... *F21V 31/005* (2013.01); *F21V 3/02* (2013.01); *F21V 19/003* (2013.01)

(58) Field of Classification Search
CPC ..... F21V 31/005; F21V 3/02; F21V 19/003
See application file for complete search history.

(56) References Cited

U.S. PATENT DOCUMENTS

| | | | | |
|---|---|---|---|---|
| 8,746,953 | B1 * | 6/2014 | Shao | F21V 1/00 362/311.02 |
| 10,047,928 | B2 * | 8/2018 | Chen | F21V 23/006 |
| 10,408,392 | B2 * | 9/2019 | Yu | F21V 23/002 |
| 2011/0116278 | A1 * | 5/2011 | Lin | B62J 6/12 362/475 |
| 2017/0292692 | A1 * | 10/2017 | Chen | F21V 31/00 |
| 2018/0128447 | A1 * | 5/2018 | Chen | F21V 17/12 |

* cited by examiner

*Primary Examiner* — Tracie Y Green
(74) *Attorney, Agent, or Firm* — Prakash Nama; Global IP Services, PLLC

(57) ABSTRACT

A high-performance waterproof LED decorative lamp, having an inner hollow lampshade, a light-emitting component built in the lampshade, and a lamp holder connected with the lampshade; one end of the lampshade protrudes to form a bayonet connected with the lamp holder, the bayonet is internally plugged with a waterproof plug, the light-emitting component is embedded in the waterproof plug, the waterproof plug is provided with an open cavity, a conductive pin is provided in the cavity, the conductive pin is electrically connected to the light-emitting component and exposed to the bottom of the bottom surface, the side of the waterproof plug is provided with a notch, and the light-emitting component is electrically connected to the inner wall of the lamp holder through the notch.

7 Claims, 4 Drawing Sheets

HIGH PERFORMANCE WATERPROOF LED DECORATIVE LAMP WITH ENHANCED WATERPROOF STRUCTURE FOR PROLONGED LIFE

BACKGROUND OF THE INVENTION

The invention relates to the technical field of lamps, in particular to a high performance waterproof LED decorative lamp.

The decorative lamp makes the decoration beautiful because it can emit dazzling light, but because the decorative lamp is generally mounted outdoors, it is easy to enter water. The reasons for the low waterproof performance of existing decorative lamp are as follows:

(1) The lampshade is a plastic product, which will have the phenomenon of thermal expansion and contraction, resulting in a gap between the lampshade and the lamp holder, and water will enter from the gap when the LED lamp is used;

(2) The existing decorative lamp generally use a spiral metal lamp holder, and the bottom has a tapered through hole made of glass fiber. The conductive pin extends outward through the tapered through hole, and then is soldered to make the conductive pin be electrically connected to an external power supply. Because the tapered through hole is made of glass fiber fired, and is not waterproof, water will enter the interior of the decorative lamp from the tapered through hole;

(3) Since the tapered through hole is a necessary passage for connecting the conductive pin, it is necessary to solder tin on the tapered through hole, and under the affection of the external factors such as the temperature of the soldering tin and the time, it is easy to cause an uneven soldering tin, so that a gap is generated at the soldering position, and water will enter the interior of the decorative lamp from the gap.

BRIEF SUMMARY OF THE INVENTION

In order to solve the above problems, the present invention provides a high performance waterproof LED decorative lamp, which can effectively improve the waterproof performance of the decorative lamp and prolong the service life of the decorative lamp.

In order to achieve the above object, the present invention adopts the following technical solution: a high performance waterproof LED decorative lamp, comprising an inner hollow lampshade, a light-emitting component built in the lampshade, and a lamp holder having upper and lower openings, wherein one end of the lampshade protrudes to form a bayonet connected with the lamp holder, the bayonet is plugged with a waterproof plug, the waterproof plug is provided with an open cavity, the light-emitting component is embedded in the cavity and electrically connected to the conductive pin, the conductive pin passes through the bottom surface of the waterproof plug and extends out of the lower opening, the bottom surface of the waterproof plug is resisted in the lower opening, the conductive pin and the waterproof plug are integrally injection-molded, the side of the waterproof plug is provided with a notch, and the light-emitting component is electrically connected to the inner wall of the lamp holder through the notch.

At the tapered electrode pin (corresponding to the conductive pin in the present application) on the bottom of the existing spiral metal lamp holder, the spiral metal lamp holder is a tapered conductive through hole made of glass fiber fired, then the electrode pin is pierced through the conductive through hole, and then tin is soldered on the through hole. A series of external factors, such as soldering temperature and time, water will be caused to enter from the tin soldered when the LED bulb is used. There is no water-proof between the electrode pin and the spiral metal holder, so water will enter from the tapered electrode plug at the bottom of the spiral metal lamp holder when the LED bulb is used. In order to effectively waterproof the tapered through hole at the bottom of the spiral metal holder and the electrode pin, the conductive pin and the waterproof plug are integrally injection molded, so as to effectively prevent water from entering the bottom of the lamp holder, and the waterproof plug blocks the lampshade bayonet, so that the waterproof plug effectively prevents water from entering the lampshade.

In some embodiments, the lamp holder forms an upper flange at the connection between the upper opening and the lampshade, and the outer surface of the bayonet is provided with a first waterproof ring, wherein when the lampshade is screwed into the lamp holder, the upper flange presses the first waterproof ring to deform, so that the first waterproof ring is elastically fitted upward on the outer surface of the bayonet, which can achieve the effect of waterproof penetration.

The lampshade is a plastic product, which will have the phenomenon of thermal expansion and contraction, resulting that water will enter from the connection between the lamp holder and the lampshade when the LED bulb is used. The first waterproof ring is pressed and deformed by the upper opening of the hollow metal lamp holder, so that the first waterproof ring is elastically fitted on the outer surface of the bayonet to provide an effective waterproof effect.

In some embodiments, the lamp holder forms a resisting ring at the lower opening, the bottom surface of the waterproof plug is provided with a conical convex portion, the outer edge of the conical convex portion is provided with a waterproof inner groove, a second waterproof ring is provided in the waterproof inner groove, wherein when the lampshade is screwed into the lamp holder, the bottom surface of the waterproof plug is pressed down and fits on the inner surface of the resisting ring, so that the second waterproof ring is elastically fitted upward on the bottom surface of the waterproof plug, and the second waterproof ring prevents water from entering the bottom end of the lamp holder, which effectively improves the waterproof performance.

In some embodiments, the lamp holder is a hollow metal lamp holder, and the hollow metal lamp holder is a ring cylinder structure. In this way, when the lampshade is screwed into the lamp holder, the hollow metal lamp holder can press the first and second waterproof rings to deform besides clamping the lampshade, thereby filling the gap between the lampshade and the upper opening of the lamp holder, and the gap between the waterproof plug and the lower opening of the lamp holder, so that the waterproof performance is further improved, and there is no need to open a tapered through hole made of glass fiber fired at the bottom, so that the overall structural connection of the LED decorative lamp is more reasonable than the existing products, and the waterproof performance is also improved.

Preferably, the light-emitting component the light-emitting component comprises a light source plate and a power supply plate electrically connected from top to bottom, and the bottom of the power supply plate is provided with a positive guide line and a negative guide line, wherein the positive guide line is electrically connected to the conductive pin, and the negative guide line is fitted on the inner wall of the lamp holder through the notch.

In some embodiments, the conductive pin is a hollow copper cylinder, the waterproof plug is made of insulating material, and the waterproof plug and the hollow copper cylinder are integrally injection-molded. In this way, the waterproof plug is high temperature resistant, waterproof and freeze-proof, and does not generate the phenomenon of thermal expansion and contraction, thereby effectively preventing water vapor from entering the light-emitting component along the conductive pin, and further improving the waterproof performance.

The beneficial effects of the present invention are as follows:

1. A first waterproof ring is provided at the connection between the lampshade and the lamp holder. When the lampshade is deformed by thermal expansion and contraction, the first waterproof ring is deformed accordingly, so that there is no gap between the lampshade and the lamp holder, and the sealing effect is ensured. The bottom of the plug is provided with a waterproof inner groove and a second waterproof ring is arranged, which can prevent water from entering the inside of the lampshade and damaging the light-emitting component. Since the first waterproof ring and the second waterproof ring are respectively pressed on the upper and lower openings of the lamp holder, the waterproof performance is effectively improved and the waterproof effect is very good.

2. A conductive pin is put into the injection molding machine and integrated with the waterproof plug for high temperature injection molding, which is high temperature resistant, waterproof and freeze-proof, and will not cause the phenomenon of thermal expansion and contraction, so as to improve the waterproof performance.

3. The lamp holder adopts a hollow metal lamp holder, and there is no need to open a tapered through hole made of glass fiber fired at the bottom, so that the overall structural connection of the LED decorative lamp is more reasonable than the existing products, and the waterproof performance is also improved.

Figure 1:
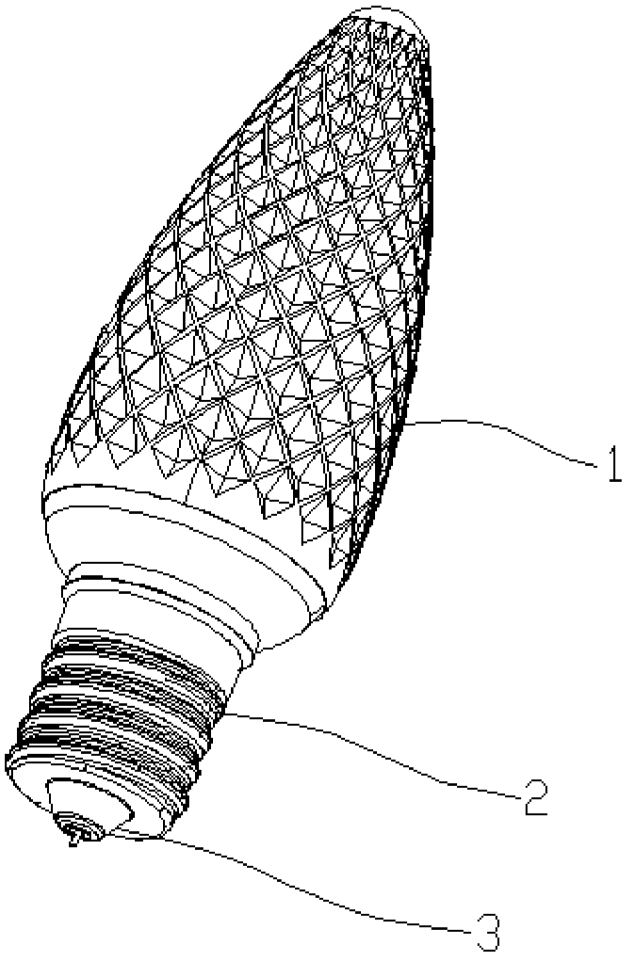
FIG. 1 is a schematic stereogram of the present invention.

Description of reference numerals: 1. lampshade; 11. light transmitting portion 11; 12. bayonet 12; 2. lamp holder; 21. threaded portion 21; 3. waterproof plug; 31. conical convex portion; 32. waterproof inner groove; 33. gap; 4. light-emitting component; 41. light source plate; 42. power supply plate; 43. positive guide line; 44. negative guide line; 5. first waterproof ring; 6. second waterproof ring; 7. conductive pin.

DETAILED DESCRIPTION OF THE INVENTION

Figure 2:
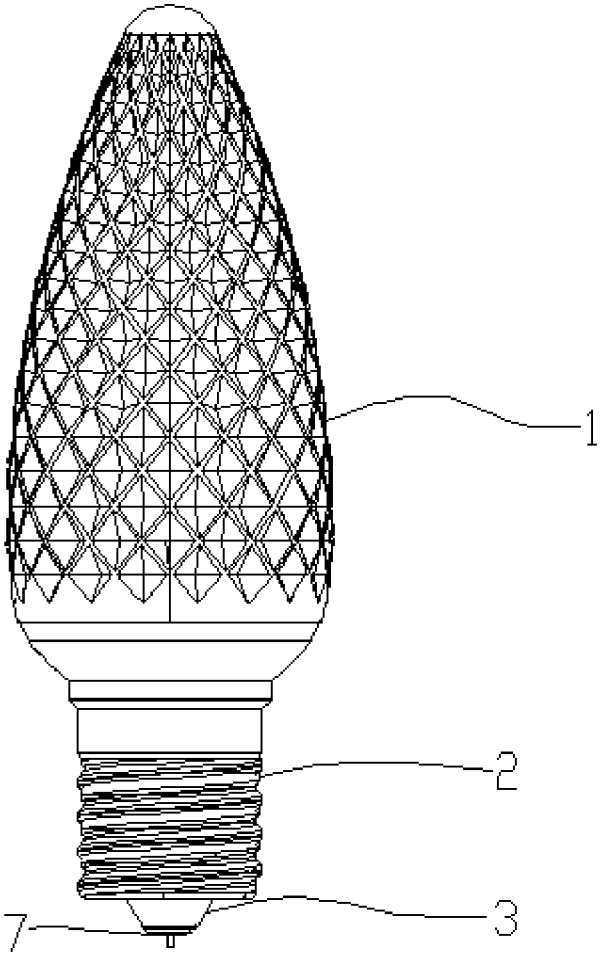
FIG. 2 is a main view of the present invention.
Figure 3:
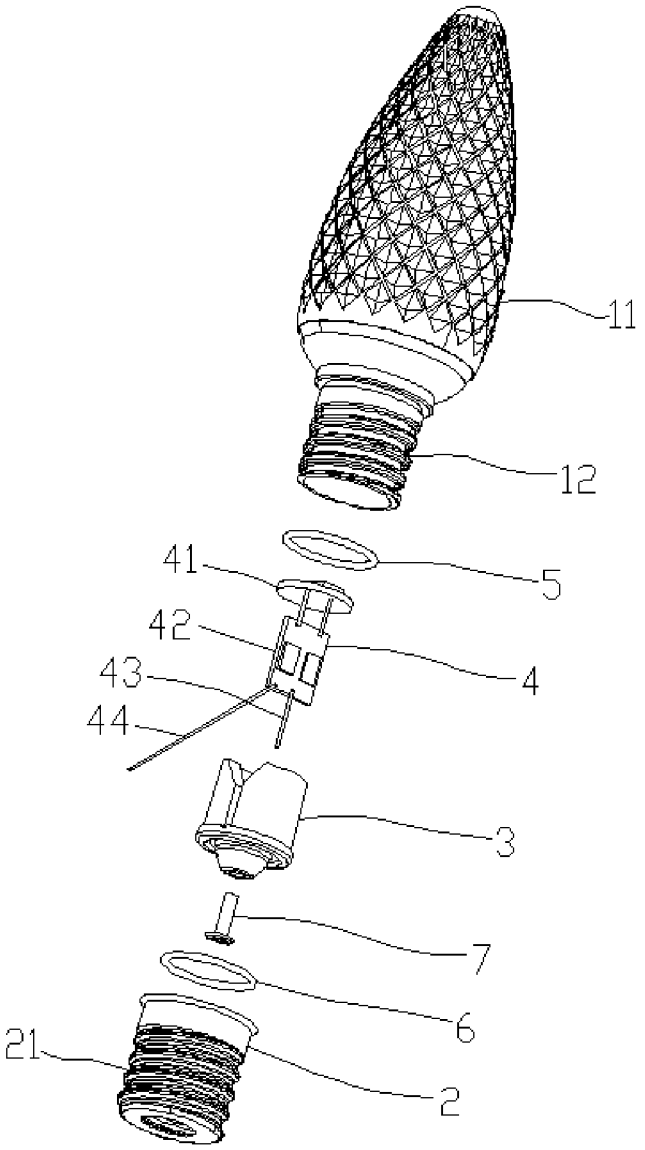
FIG. 3 is an exploded structure diagram of the present invention.
Figure 4:
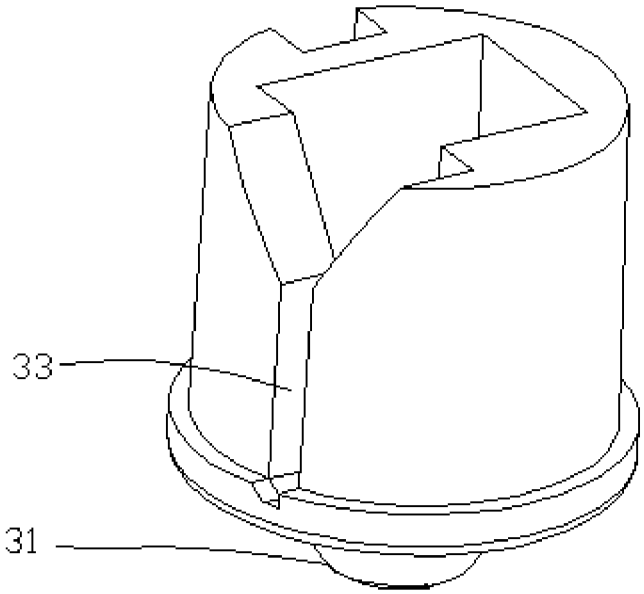
FIG. 4 is a schematic stereogram of the waterproof plug.
Figure 5:
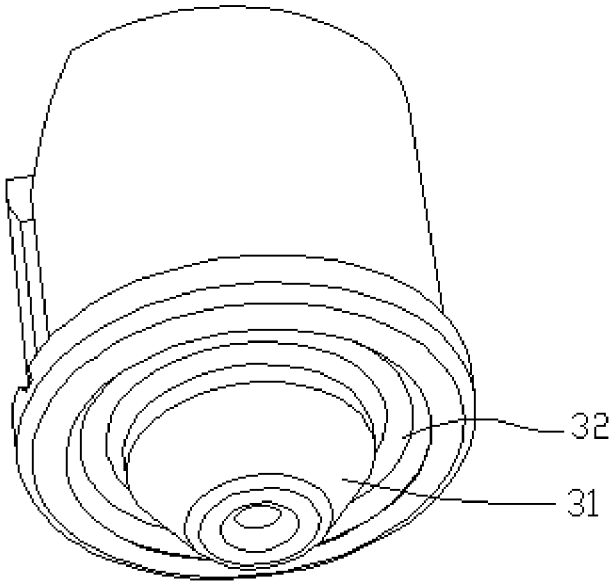
FIG. 5 is a schematic stereogram of another direction of the waterproof plug.

Referring to FIGS. 1-5, the present invention relates to a high performance waterproof LED decorative lamp, comprising an inner hollow lampshade 1, a light-emitting component 4 built in the lampshade 1, and a lamp holder 2 connected to the lampshade 1. The lamp holder 2 is a hollow metal lamp holder 2, the hollow metal lamp holder 2 is a ring cylinder body having upper and lower openings, and the inner wall of the ring cylinder is provided with an internal threaded portion 21. The ring cylinder body forms an upper flange at the connection between the upper opening and the lampshade 1. The ring cylinder body forms a resisting ring at the lower opening. Compared with the spiral metal lamp holder 2, there is no need to open a tapered through hole made of glass fiber fired at the bottom to improve the waterproof performance. The lampshade 1 includes the light transmitting portion 11, and a bayonet 12 protruding along one end of the light transmitting portion and connected to the lamp holder. The bayonet 12 is internally plugged with a waterproof plug 3. The light-emitting component 4 is embedded in the waterproof plug 3, and the waterproof plug 3 prevents water from entering the lampshade, thereby improving waterproof performance. The outer wall of the light transmitting portion 11 is provided with a decorative pattern, and the bayonet 12 is provided with an external thread. The upper flange of the lamp holder 2 make the first waterproof ring be abutted the connection between the lamp holder and the lampshade. The upper end of the waterproof plug 3 is an open structure. The middle portion of the waterproof plug 3 is provided with a cavity, and the side of the cavity is provided with a notch 33. The bottom surface of the waterproof plug is provided with a conical convex portion, the conical convex portion is provided with a through hole, and the cavity is provided with a conductive pin 7. The conductive pin protrudes into the through hole and is integrally formed with the waterproof plug 3. The outer edge of the conical convex portion is provided with a waterproof inner groove 32. The waterproof inner groove 32 has a second waterproof ring 6 embedded therein. The conical convex portion passes through the resisting ring and is exposed outside the lamp holder, so that the second waterproof ring is resisted on the resisting ring. The lamp holder 2 is screw-locked to the lampshade 1, so that the first waterproof ring 5 and the second waterproof ring 6 are respectively deformed by force and pressed against the upper and lower openings of the lamp holder 2, that is, the upper flange of the lamp holder 2 presses the first waterproof ring 5 to deform, so that the first waterproof ring is elastically fitted upward on the surface of the lampshade, and the resisting ring of the lamp holder 2 presses the second waterproof ring 6 to deform, and the bottom surface of the waterproof plug is pressed down and fitted on the inner surface of the resisting ring, so that the second waterproof ring is elastically fitted upward on the bottom surface of the waterproof plug, thereby achieving the effect of waterproof penetration.

Preferably, the waterproof plug 3 is made of insulating material, and is formed by integral high temperature injection molding.

Preferably, the conductive pin 7 is a hollow copper cylinder, and is formed by integral high temperature injection molding.

Preferably, the light-emitting component 4 includes a light source plate 41 and a power supply plate 42 electrically connected from top to bottom. The light source plate 41 and the power supply plate 42 are electrically connected by two conductive pins, and the bottom of the power supply plate 42 is provided with a positive guide line and a negative guide line. The positive guide line is electrically connected to the conductive pin 7, wherein the positive guide line and the conductive pin are connected by solder, to ensure the conductive property of the positive guide line of the power supply plate. The negative guide line wire passes through the notch 33 and is fitted on the inner wall of the lamp holder 2. The light source plate 41 is electrically connected with a plurality of LED lamp beads.

The present invention relates to an assembly method of a high-performance waterproof LED decorative lamp, in which a first waterproof ring is nested at a bayonet of a lampshade, and a light source plate is connected with a power supply plate by two conductive pins. A positive guide line and a negative guide line are taken out from the bottom of the power supply plate, and the positive guide line of the power supply plate inserted into a cavity of an insulating waterproof plug. There is a hollow copper cylinder conductive pin in the cavity. The positive guide line is electrically connected with the hollow copper cylinder conductive pin through soldering tin, to ensure the conductive performance of the positive guide line of the power supply plate. The negative guide line is stretched and cut into the notch of the insulating waterproof plug, the insulating waterproof plug is pushed into the bayonet, and the negative guide line of the power supply plate is fitted to the external thread of the lampshade. The waterproof inner groove of the insulating waterproof plug is provided with a second waterproof ring, and the hollow metal lamp holder is locked into the lampshade.

The present invention completely changes the structure of the traditional lamp cap, and uses a waterproof plug to block the bayonet, thereby effectively preventing water from entering the lampshade, and the optimized structure of the waterproof plug prevents water from entering the light-emitting component. Since the first waterproof ring and the second waterproof ring are respectively pressed on the upper and lower openings of the lamp holder, the waterproof penetration effect can be achieved and the waterproof performance can be effectively improved. The hollow metal lamp holder 2 is selected to replace the existing spiral metal lamp holder 2, and it is not necessary to open a conical through hole made of glass fiber fired to prevent the lamp holder 2 from entering water due to its own manufacturing process problem; the waterproofing plug 3 is inserted into the bayonet of the lampshade. A conductive pin 7 passes through the waterproof plug 3. The waterproof plug 3 and conductive pin 7 are both formed by high-temperature injection molding, can withstand high temperature, fire rating thereof is V0, and is waterproof and freeze-proof, will not be deformed due to temperature changes. The positive guide line passes through the conductive pin and is connected with the conductive pin through soldering tin, which simplifies the soldering process, makes the colder convenient, and has high waterproof performance. After the lampshade 1 and the lamp holder 2 are locked, the conductive ring 5 and the second waterproof ring 6 are respectively tightly pressed on the top and bottom of the lamp holder 2. The first waterproof ring 5 can be correspondingly deformed with the deformation of the lampshade 1 due to thermal expansion and contraction, reducing the connection gap between the lampshade 1 and the lamp holder 2. The first waterproof ring 5 and the second waterproof ring 6 can provide a good sealing effect and effectively increase the overall waterproof performance.

The above embodiments are merely illustrative of the preferred embodiments of the present invention, and are not intended to limit the scope of the present invention. Without departing from the design spirit of the present invention, various modifications and improvements made by ordinary engineers and technicians in the field to the technical solution of the invention shall fall within the protection scope determined by the claims of the present invention.

What is claimed is:

1. A high-performance waterproof LED decorative lamp comprising an inner hollow lampshade, a light-emitting component built in the lampshade, and a lamp holder having upper and lower openings, wherein one end of the lampshade protrudes to form a bayonet connected with the lamp holder, the bayonet is internally plugged with a waterproof plug, the waterproof plug is provided with an open cavity, the light-emitting component is embedded in the cavity and electrically connected to the conductive pin, the conductive pin passes through the bottom surface of the waterproof plug and extends out of the lower opening, the bottom surface of the waterproof plug is resisted in the lower opening, the conductive pin and the waterproof plug are integrally injection-molded, the side of the waterproof plug is provided with a notch, and the light-emitting component is electrically connected to the inner wall of the lamp holder through the notch.

2. The high performance waterproof LED decorative lamp according to claim 1 is characterized in that the lamp holder forms an upper flange at the connection between the upper opening and the lampshade, and the outer surface of the bayonet is provided with a first waterproof ring, wherein when the lampshade is screwed into the lamp holder, the upper flange presses the first waterproof ring to deform, so that the first waterproof ring is elastically fitted upward on the outer surface of the bayonet.

3. The high-performance waterproof LED decorative lamp according to claim 2 is characterized in that the lamp holder forms a resisting ring at the lower opening, the bottom surface of the waterproof plug is provided with a conical convex portion, the outer edge of the conical convex portion is provided with a waterproof inner groove, a second waterproof ring is provided in the waterproof inner groove, wherein when the lampshade is screwed into the lamp holder, the bottom surface of the waterproof plug is pressed down and fits on the inner surface of the resisting ring, so that the second waterproof ring is elastically fitted upward on the bottom surface of the waterproof plug.

4. The high performance waterproof LED decorative lamp according to claim 1 is characterized in that the lamp holder is a hollow metal lamp holder, and the hollow metal lamp holder is a ring cylinder structure.

5. The high performance waterproof LED decorative lamp according to claim 1 is characterized in that the conductive pin is a hollow copper cylinder, and the hollow copper cylinder and the waterproof plug are integrally injection-molded.

6. The high performance waterproof LED decorative lamp according to claim 1 is characterized in that the waterproof plug is made of insulating material.

7. The high-performance waterproof LED decorative lamp according to claim 1 is characterized in that the light-emitting component comprises a light source plate and a power supply plate electrically connected from top to bottom, and the bottom of the power supply plate is provided with a positive guide line and a negative guide line, wherein the positive guide line is electrically connected to the conductive pin, and the negative guide line is fitted on the inner wall of the lamp holder through the notch.

* * * * *